US012446687B1

(12) United States Patent
Pu

(10) Patent No.: US 12,446,687 B1
(45) Date of Patent: Oct. 21, 2025

(54) FLAT MESH PANEL COMPRISING AT LEAST TWO SIDE RODS AND A PLURALITY OF CROSSBARS

(71) Applicant: GAATU INC, Tracy, CA (US)

(72) Inventor: Yubin Pu, Tracy, CA (US)

(73) Assignee: GAATU INC, Tracy, CA (US)

( * ) Notice: Subject to any disclaimer, the term of this patent is extended or adjusted under 35 U.S.C. 154(b) by 0 days.

(21) Appl. No.: 18/637,526

(22) Filed: Apr. 17, 2024

(51) Int. Cl.
*A47B 61/00* (2006.01)

(52) U.S. Cl.
CPC ..... *A47B 61/00* (2013.01)

(58) Field of Classification Search
CPC A47B 61/00; A47B 61/02; A47F 7/24; A47G 25/0692; A47G 25/0664
USPC ..... 211/13.1, 187, 88.04, 88.01, 94.03, 204, 211/206, 123
See application file for complete search history.

(56) References Cited

U.S. PATENT DOCUMENTS 1,377,682 A * 5/1921 Henderson ..... A47G 25/0692 211/7
2,589,269 A * 3/1952 Magnuson ..... A47B 61/003 211/186
3,187,904 A * 6/1965 Kiechle ..... A47G 25/1457 211/118
3,503,525 A * 3/1970 Loebner ..... A47G 25/0664 211/195
3,865,336 A * 2/1975 Robertson ..... A47B 61/00 108/29
3,921,814 A * 11/1975 Solomon ..... A47G 25/0692 211/124
4,493,423 A * 1/1985 Kaeslin ..... A47G 25/06 108/29
4,697,712 A * 10/1987 Valiulis ..... A47F 5/01 211/187
4,762,238 A * 8/1988 Blanchard ..... A47G 25/0692 223/85
5,044,505 A * 9/1991 Spratt ..... B62H 3/12 211/85.7
5,331,904 A * 7/1994 DiSimone ..... B25H 1/18 108/26
5,492,295 A * 2/1996 Remmers ..... A47F 5/14 248/251
5,495,970 A * 3/1996 Pedrini ..... B60R 9/10 224/329
5,857,577 A * 1/1999 Thomas ..... A47B 96/061 211/94.01
6,302,281 B1 * 10/2001 Wang ..... A47B 43/00 190/13 R
D459,044 S * 6/2002 Felsenthal ..... D34/21
6,464,090 B1 * 10/2002 Martinez ..... A63B 55/10 D6/552
6,488,159 B2 * 12/2002 Shuen ..... A47G 25/0692 211/105.3

(Continued)

*Primary Examiner* — Jennifer E. Novosad
(74) *Attorney, Agent, or Firm* — Li & Cai Intellectual Property (USA) Office

(57) ABSTRACT

A flat mesh panel with at least two side rods and a plurality of crossbar that are related to the field of clothing equipment technology, includes at least two side rods and a crossbar disposed between the at least two side rods. The crossbar is connected to the side rod through a detachable connecting assembly. A side of the side rod is connected to a descending rod through the detachable connecting assembly, and the descending rod is detachably connected to the crossbar.

6 Claims, 6 Drawing Sheets

(56) References Cited

U.S. PATENT DOCUMENTS

| | | | | |
|---|---|---|---|---|
| 6,604,473 | B2 * | 8/2003 | Felsenthal | D06F 95/002 211/85.24 |
| 7,611,035 | B2 * | 11/2009 | Settelmayer | B60R 9/06 224/519 |
| 8,047,492 | B2 * | 11/2011 | Wang | B62H 3/12 211/106.01 |
| 8,499,888 | B2 * | 8/2013 | Fontaine | E04G 5/003 211/113 |
| 9,949,585 | B2 * | 4/2018 | Chua | D06F 59/02 |
| 10,098,489 | B2 * | 10/2018 | Mustafa | A47G 25/0685 |
| 10,681,978 | B2 * | 6/2020 | Lim | A47B 47/0041 |
| 10,786,075 | B1 * | 9/2020 | Ghiorghie | A47B 87/0215 |
| 10,988,892 | B1 * | 4/2021 | Lu | A47G 25/0664 |
| D966,731 | S * | 10/2022 | Tang | D6/403 |
| D1,037,726 | S * | 8/2024 | Pu | D6/675.2 |
| 2006/0054063 | A1 * | 3/2006 | Ryan | A47B 47/0083 108/27 |
| 2006/0231516 | A1 * | 10/2006 | Moore | A47G 25/0692 211/85.3 |
| 2007/0095773 | A1 * | 5/2007 | Schwerman | A47B 47/0091 211/187 |
| 2016/0007742 | A1 * | 1/2016 | Yang | A47B 61/00 211/123 |
| 2020/0138187 | A1 * | 5/2020 | Lim | A47B 47/021 |

* cited by examiner

FLAT MESH PANEL COMPRISING AT LEAST TWO SIDE RODS AND A PLURALITY OF CROSSBARS

FIELD OF THE DISCLOSURE

The present disclosure relates to the technical field of clothing equipment technology, and more particularly to a flat mesh panel and a wardrobe.

BACKGROUND OF THE DISCLOSURE

A basic wardrobe serves as a convenient and practical storage furniture primarily designed for clothing, and typically consists of easily assembled and disassembled components. In addition, it has simplicity in design yet full function for home or dormitory use. Constructed from lightweight materials such as plastic, fabric, or metal, the basic wardrobe offers portability and easy storage.

Conventionally, most basic wardrobes feature integrated mesh tops. However, in today's era dominated by online shopping, since the integrated mesh occupies a large horizontal packaging space, it is not only inconvenient to transport, but also makes the transportation cost higher.

SUMMARY OF THE DISCLOSURE

The technical problem addressed by the present disclosure is the conventional use of integrated mesh on the top of basic wardrobes, which poses challenges in the era of online shopping due to its significant horizontal packaging space requirement. This not only hampers transportation convenience but also escalates transportation costs. To remedy these drawbacks, a flat mesh panel is proposed.

The technical solution presented by the present disclosure is as follows.

A flat mesh panel is provided, including at least two side rods and a crossbar disposed between the at least two side rods. The crossbar is connected to the side rod through a detachable connecting assembly. A side of a side rod away from the crossbar is connected to a descending rod through the detachable connecting assembly, and the descending rod is detachably connected to the crossbar.

Preferably, the side rod includes a top rod and a bottom rod, and a wave-shaped connecting curved rod is disposed between the top rod and the bottom rod. A peak and a valley of the wave-shaped connecting curved rod are respectively connected to the top rod and the bottom rod.

Preferably, the detachable connecting assembly includes connection holes located arranged at both ends of the crossbar, and a fastener that tightly fits with the connection hole.

Preferably, a spacer block is disposed on a side of the wave-shaped connecting curved rod away from the crossbar, and the spacer block has a through-hole for the fastener to pass through to be securely engaged to the connection hole.

Preferably, the connection hole is a threaded hole, and the fastener is a hand-tightened screw component.

Preferably, both ends of the side rod are provided with sleeves.

Preferably, the descending rod has, from top to bottom, an upper hook part, a connecting part, a bending-back part, and an assembling part. An angle between the upper hook part and the connecting part is 60 degrees to 90 degrees, and the connecting part is provided with a through-slot for the fastener to pass through. The bending-back part bends towards a direction of the crossbar, and the assembling part is provided with the through-hole.

Preferably, the through-slot correspondingly penetrates through the upper hook part and the connecting part and divides the upper hook part into a left hook part and a right hook part.

Preferably, the hand-tightened screw component has a threaded cylinder and a cylinder head, a tightening piece is arranged between the threaded cylinder and the cylinder head, the tightening piece is cylindrical, and a diameter of the tightening piece is greater than a width of the through-slot and a diameter of the through-hole.

A wardrobe including the flat mesh panel described above is provided.

The beneficial effects of the present disclosure are as follows. The flat mesh panel and the wardrobe of the present disclosure are provided with the at least two side rods and the crossbar disposed between the at least two side rods, in which the crossbar is connected to the side rod through the detachable connecting assembly, the side of the side rod away from the crossbar is connected to the descending rod through the detachable connecting assembly, and the descending rod is detachably connected to the crossbar. When it is necessary to assemble flat mesh panel of the present disclosure, one or more crossbars can be disposed between two side bars, and the two ends of each of the crossbars can be respectively connected to the two side bars through the detachable connecting assembly. Therefore, the present disclosure provides a flat wardrobe top that can be spliced together, and a user can hang the clothes hanger on the crossbar, so as to achieve the purpose of conveniently storing clothes without occupying too much area.

When it is needed to dissemble and package the flat mesh panel of the present disclosure, the side rods, the crossbar and the descending rod can be disassembled through the detachable connecting assembly, so that when packaging the side rods, the crossbar and the descending rod, only the side rods, the crossbar and the descending rod need to be arranged side by side for packaging. It can reduce the horizontal packaging space, thereby achieving the purpose of convenient transportation and reducing transportation costs.

BRIEF DESCRIPTION OF THE DRAWINGS

In order to provide a clearer explanation of the embodiments of the present disclosure and its technical solutions, the present disclosure will be further described below with reference to the accompanying drawings and examples. It should be noted that the drawings presented herein represent only some embodiments of the present disclosure, and other drawings can be derived by those skilled in the art based on these drawings without requiring additional creative effort.

Figure 1:
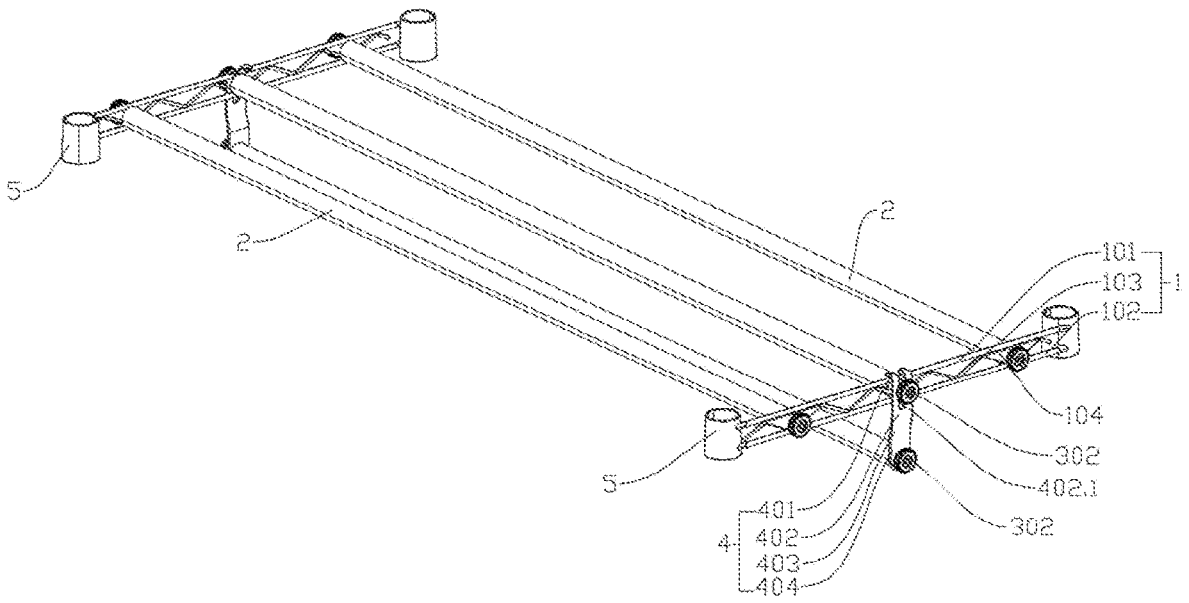
FIG. 1 is a schematic perspective view of an overall structure according to the present disclosure.

Reference numeral: 1, side rod; 101, top rod; 102, bottom rod; 103, wave-shaped connecting curved rod; 104, spacer block; 104.1, through-hole; 2, crossbar; 302, fastener; 302.1, threaded cylinder; 302.2, cylinder head; 302.3, tightening piece; 4, descending rod; 401, upper hook part; 401.1, left hook part; 401.2, right hook part; 402, connecting part; 402.1, through-slot; 403, bending-back part; 404, assembling part; 5, sleeve.

DETAILED DESCRIPTION OF THE EXEMPLARY EMBODIMENTS

In order to make the purpose, technical solutions and advantages of the present disclosure clearer, the technical solutions in present disclosure will be clearly and completely described below in conjunction with the drawings of the present disclosure. Obviously, the described embodiments are some, but not all, of the embodiments of the present disclosure. Based on the embodiments of the present disclosure, all other embodiments obtained by those of ordinary skill in the art without making creative efforts fall within the scope of protection of the present disclosure.

In the description of the embodiments of the present disclosure, it should be noted that, unless otherwise clearly stated and limited, the terms "connecting" and "connected" should be understood in a broad sense. For example, it can be a fixed connection, a detachable connection, or an integral connection; it can be a mechanical connection or an electrical connection; it can be a direct connection or an indirect connection through an intermediate medium. For those of ordinary skill in the art, the specific meanings of the above terms in the embodiments of the present disclosure can be understood in specific situations.

In the embodiments of the present disclosure, otherwise expressly stated and limited, a first feature being "on" or "below" a second feature may mean that the first and second features are in direct contact, or the first and second features are in indirect contact through an intermediary. Furthermore, the terms "above", "on" and "upon" the first feature is above the second feature may mean that the first feature is directly above or diagonally above the second feature, or simply means that the first feature is higher in level than the second feature. "Below", "under" and "beneath" the first feature to the second feature may mean that the first feature is directly below or diagonally below the second feature, or simply means that the first feature has a smaller horizontal height than the second feature.

In the description of the present disclosure, reference to the terms "one embodiment," "some embodiments," "an example," "specific examples," or "some examples" or the like means that specific features are described in connection with the embodiment or example, structures, materials or features are included in at least one embodiment or example of the embodiments of the present disclosure. In the present disclosure, the schematic expressions of the above terms are not necessarily directed to the same embodiment or example. Furthermore, the specific features, structures, materials or characteristics described may be combined in any suitable manner in any one or more embodiments or examples. In addition, those skilled in the art may combine and combine different embodiments or examples and features of different embodiments or examples described in this specification unless they are inconsistent with each other.

The embodiment of the present disclosure, as illustrated in FIGS. 1 to 6, involves a flat mesh panel, including at least two side rods 1, and a crossbar 2 disposed between the side rods 1. The crossbar 2 is connected to the side rod 1 through a detachable connecting assembly. A side of the side rod 1 away from the crossbar 2 is connected to the descending rod 4 through the detachable connecting assembly, and the descending rod 4 is detachably connected to the crossbar 2. When it is necessary to assemble the flat mesh panel of the present disclosure, one or more crossbars 2 can be disposed between two side bars 1. Two ends of each of the one or more crossbars 2 are respectively connected to the two side rods 1 through the detachable connecting assembly, so that the present disclosure provides a flat wardrobe top that can be spliced together, and a user can hang clothes hangers on the crossbars 2, which makes it easy to store clothes and pants. Furthermore, the descending rod 4 can be connected to the side bar 1 through the detachable connecting assembly, and the crossroad 2 is provided on the descending rod 4, so that more clothes and trousers can be hung and stored. When the flat mesh panel of the present disclosure is dissembled and packaged, the side rods 1, the crossbar 2 and the descending rod 4 can be disassembled by removing the detachable connecting assembly, so that when packaging the side rods 1, the crossbar 2 and the descending rod 4, the horizontal packaging space can be reduced, thereby achieving the purpose of convenient transportation and reducing transportation costs.

Referring to FIGS. 1 to 6, in the present embodiment, the side rod 1 includes a top rod 101 and a bottom rod 102, and a wave-shaped connecting curved rod 103 is disposed between the top rod 101 and the bottom rod 102. A peak and a valley of the wave-shaped connecting curved rod 103 are respectively connected to the top rod 101 and the bottom rod 102. Further, by setting the side rod 1 as the top rod 101 and the bottom rod 102, and providing the wave-shaped connecting curved rod 103 between the top rod 101 and the bottom rod 102, a weight of the side rod 1 can be reduced while strengthening the connection between the top rod 101 and the bottom rod 102. In the present embodiment, the detachable connecting assembly includes connection holes (not shown in the figures) arranged at both ends of the crossbar 2 and a fastener 302 that tightly fits into the connection hole (not shown in the figures).

Further, the connection hole (not shown in the figures) is a threaded hole, and the fastener 302 is a hand-tightened screw component. Additionally, the hand-tightened screw component has a threaded cylinder 302.1 and a cylinder head 302.2, and a tightening piece 302.3 is arranged between the threaded cylinder 302.1 and the cylinder head 302.2. The tightening piece 302.3 is cylindrical, with a diameter greater than a width of the through-slot 402.1 and a diameter of the through-hole 104.1. Specifically, one end of the tightening piece 302.3 adjacent to the crossbar 2 is provided with an anti-slip pattern. When using the hand-tightened screw component to match the threaded hole, if the diameter of the cylinder head 302.2 of the hand-tightened screw component is greater than a distance between the top rod 101 and the bottom rod 102, the hand-tightened screw component can be used to match the threaded hole. In this case, the cylinder head 302.2 of the hand-tightened screw component is pressed against a side of the top rod 101 or a side of the bottom rod 102 away from the crossbar 2, and the hand-tightened screw component does not need to be assembled with a screwdriver.

Further, a spacer block 104 is disposed on a side of the wave-shaped connecting curved rod 103 away from the crossbar 2. The spacer block 104 has a through-hole 104.1 for the fastener 302 to pass through to be securely engaged to the connection hole. Additionally, the presence of the spacer block 104 increases a contact area with the wave-shaped connecting curved rod 103 and enhances a stability of the hand-tightened screw component with the threaded hole, thereby preventing loosening of the hand-tightened screw component.

In the present embodiment, both ends of the side rod 1 are provided with sleeves 5. The presence of the sleeves 5 allows uprights on the wardrobe to be inserted into the sleeves 5 to achieve connection with the side rods 1.

In the present embodiment, the descending rod 4 has an upper hook part 401, a connecting part 402, a bending-back part 403, and an assembling part 404, arranged from top to bottom. An angle between the upper hook part 401 and the connecting part 402 is 60 degrees to 90 degrees. The connecting part 402 is provided with a through-slot 402.1 for the threaded cylinder 302.1 to pass through. The bending-back part 403 bends towards a direction of the crossbar 2, and the assembling part 404 is provided with the through-hole 104.1. Further, the preferred angle between the upper hook part 401 and the connecting part 402 is 90 degrees. By hooking the upper hook part 401 onto the top rod 101, a descending displacement of the descending rod 4 can be limited, making it more stable.

Specifically, the angle between the upper hook part 401 and the connecting part 402 can also be 60 degrees, and a connection between the upper hook part 401 and the connecting part 402 is rounded, so as to increase a contact area between the upper hook part 401 and the top rod 101, thereby increasing friction and ensuring that the upper hook part 401 is more stable when being hooked onto the top rod 101. Further, since the bending-back part 403 is bent toward the direction of the crossbar 2, a side of the assembling part 404 adjacent to the crossbar 2 and a side of the side bar 1 adjacent to the crossbar 2 are coplanar but in different layers. The coplanar but in different layers means the X-axis and Y-axis positions of the side of the assembling part 404 adjacent to the crossbar 2 and the side of the at least two side bars 1 adjacent to the crossbar 2 are the same, but the positions of the Z-axis are different.

Figure 2:
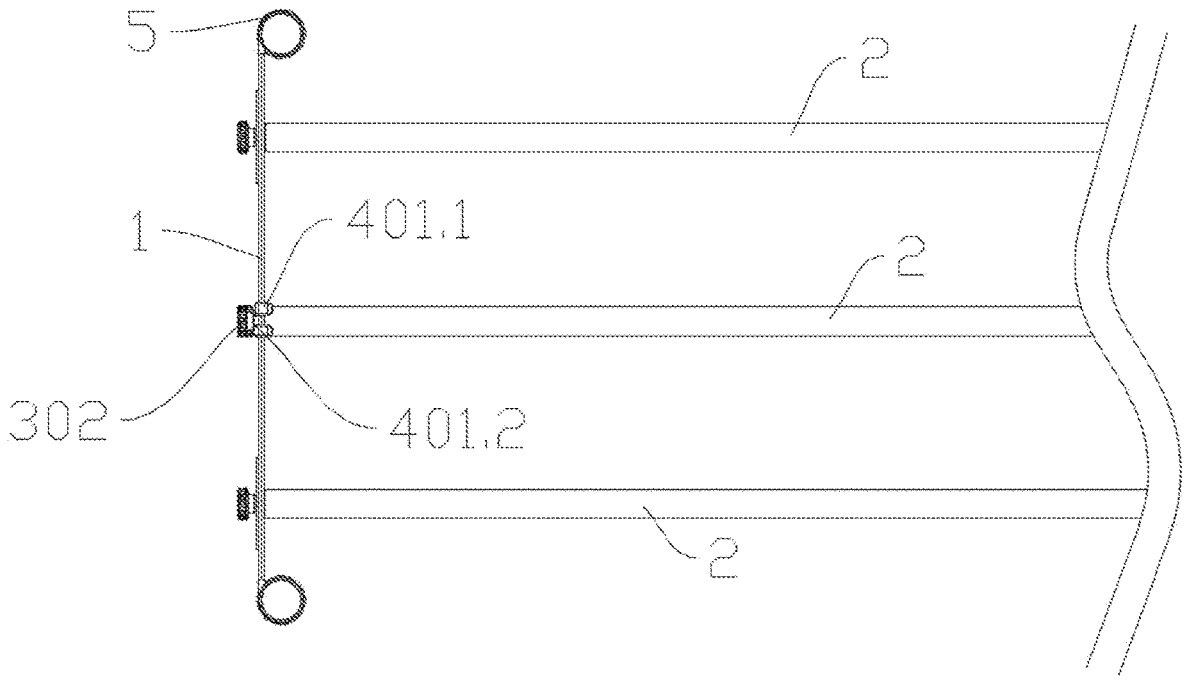
FIG. 2. is a schematic top view of a partial structure according to the present disclosure.
Figure 3:
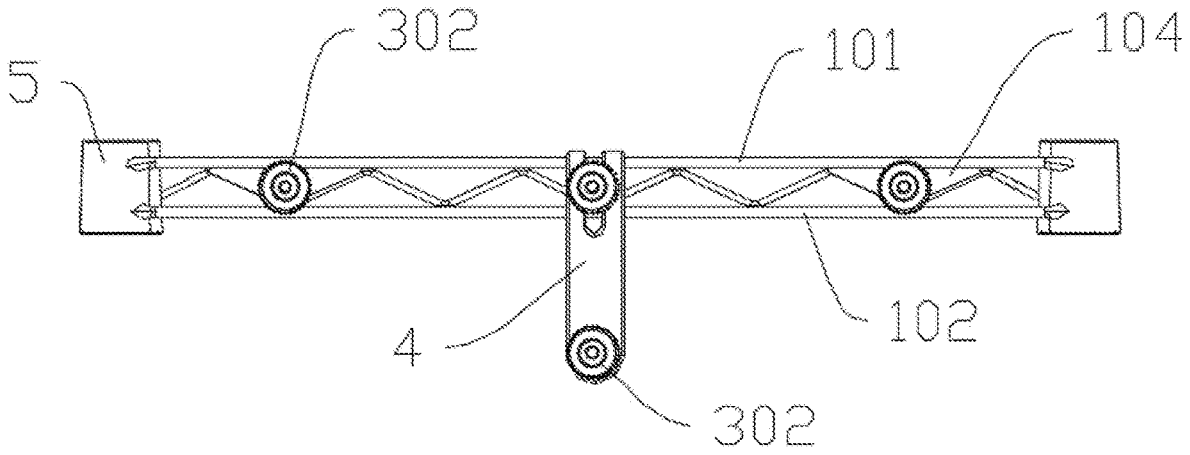
FIG. 3 is a schematic side view according to the present disclosure.
Figure 4:
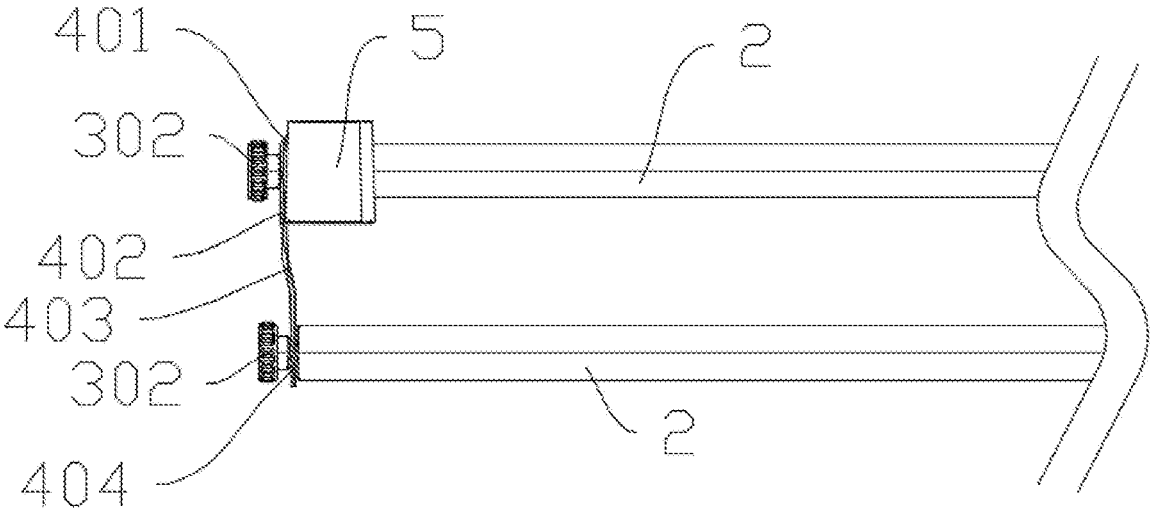
FIG. 4 is a schematic front view according to the present disclosure.
Figure 5:
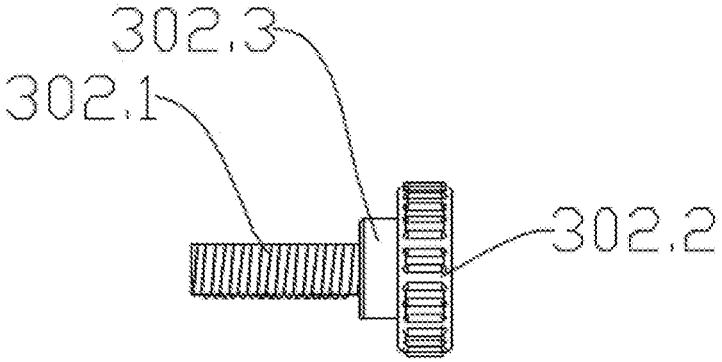
FIG. 5 is a schematic front view of a fastener according to the present disclosure.
Figure 6:
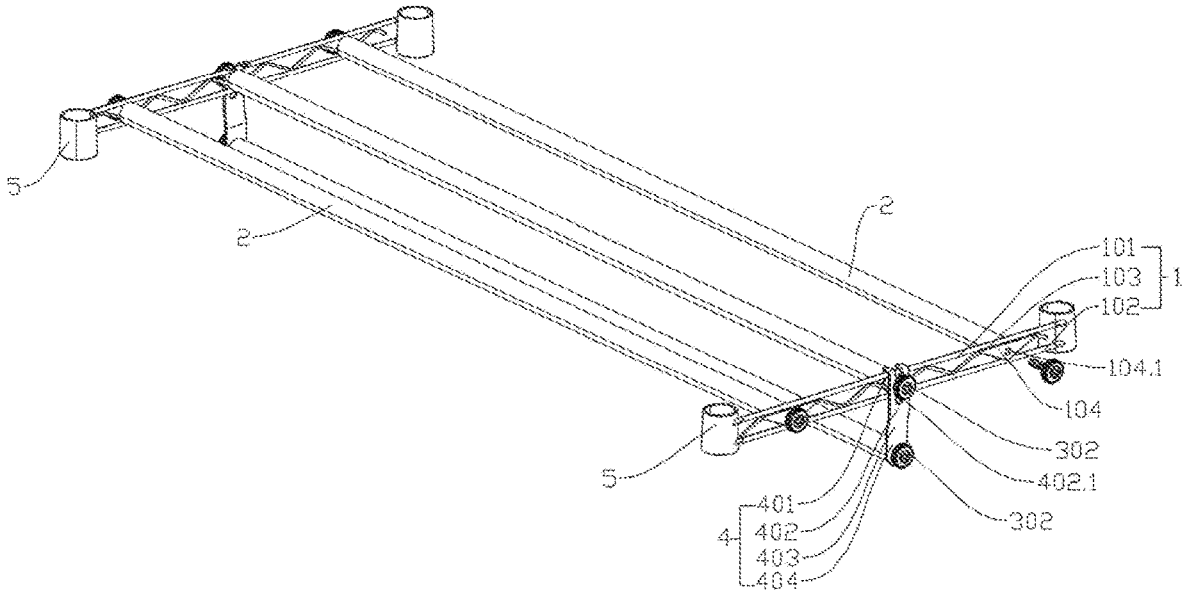
FIG. 6 is a schematic perspective view of a structure in which the fastener is disassembled according to the present disclosure.

Referring to FIGS. 1 to 3, in the present embodiment, the through-slot 402.1 correspondingly penetrates through the upper hook part 401 and the connecting part 402, and divides the upper hook part 401 into a left hook part 401.1 and a right hook part 401.2. This achieves the purpose of saving materials without affecting the stability of the upper hook part 401.

One embodiment of the present disclosure is to provide a wardrobe including the flat mesh panel.

It should be understood that for those skilled in the art, improvements or modifications can be made based on the above description, and all such improvements and modifications should fall within the scope of the claims attached to the present disclosure.

What is claimed is:

1. A flat mesh panel comprising at least two side rods (1) and a plurality of crossbars (2), wherein the plurality of crossbars are disposed between the at least two side rods (1) to form a panel, and each of the plurality of crossbars (2) is connected to a side rod (1) through a detachable connecting assembly; wherein a side of the side rod (1) is connected to a descending rod (4) through the detachable connecting assembly, and the descending rod (4) is detachably connected to the crossbar (2);

wherein the side rod (1) includes a top rod (101) and a bottom rod (102), and a wave-shaped connecting curved rod (103) is disposed between the top rod (101) and the bottom rod (102), a peak and a valley of the wave-shaped connecting curved rod (103) are respectively connected to the top rod (101) and the bottom rod (102);

wherein the detachable connecting assembly includes connection holes arranged at both ends of the crossbar (2), and a fastener (302) that fits with one of the connection holes;

wherein a spacer block (104) is disposed on a side of the wave-shaped connecting curved rod (103), and the spacer block (104) has a through-hole (104.1) for the fastener (302) to pass through to be securely engaged to the connection hole.

2. The flat mesh panel comprising the at least two side rods (1) and the plurality of crossbars (2) according to claim 1, wherein the connection hole is a threaded hole, and the fastener (302) is a hand-tightened screw component.

3. The flat mesh panel comprising the at least two side rods (1) and the plurality of crossbars (2) according to claim 2, wherein the descending rod (4) has, from top to bottom, an upper hook part (401), a connecting part (402), a bending-back part (403), and an assembling part (404); wherein an angle between the upper hook part (401) and the connecting part (402) is 60 degrees to 90 degrees, and the connecting part (402) is provided with a through-slot (402.1) for the fastener (302) to pass through; wherein the bending-back part (403) bends towards a direction of the crossbar (2), and the assembling part (404) is provided with the through-hole (104.1).

4. The flat mesh panel comprising the at least two side rods (1) and the plurality of crossbars (2) according to claim 3, wherein the through-slot (402.1) correspondingly penetrates through the upper hook part (401) and the connecting part (402) and divides the upper hook part (401) into a left hook part (401.1) and a right hook part (401.2).

5. The flat mesh panel comprising the at least two side rods (1) and the plurality of crossbars (2) according to claim 3, wherein the hand-tightened screw component has a threaded cylinder (302.1) and a cylinder head (302.2), a tightening piece (302.3) is arranged between the threaded cylinder (302.1) and the cylinder head (302.2), the tightening piece (302.3) is cylindrical, and a diameter of the tightening piece (302.3) is greater than a width of the through-slot (402.1) and a diameter of the through-hole (104.1).

6. The flat mesh panel comprising the at least two side rods (1) and the plurality of crossbars (2) according to claim 1, wherein both ends of the side rod (1) are provided with sleeves (5).

* * * * *